United States Patent [19]

Carter et al.

[11] 4,391,202

[45] Jul. 5, 1983

[54] PAPERBOARD LOAD-SUPPORTING PALLET

[76] Inventors: Leewood C. Carter, 18 Upper Warren Way, Warren, N.J. 07060; Robin P. Neary, 53 Castle Way, Basking Ridge, N.J. 07920

[21] Appl. No.: 231,930

[22] Filed: Feb. 6, 1981

[51] Int. Cl.[3] ..... B65D 19/34

[52] U.S. Cl. ..... 108/51.3; 108/55.3

[58] Field of Search ..... 108/51.3, 51.1, 55.1, 108/55.3, 56.1; 206/399, 600, 386

[56] References Cited

U.S. PATENT DOCUMENTS

| | | | |
|---|---|---|---|
| 2,444,183 | 6/1948 | Cahners | 108/51.3 |
| 3,092,046 | 6/1963 | Davidson | 108/51.3 |
| 3,135,228 | 6/1964 | Fleming et al. | 108/55.1 X |
| 3,273,518 | 9/1966 | Shina | 108/51.3 |
| 3,520,258 | 7/1970 | Shepherd | 108/51.3 |
| 3,601,067 | 8/1971 | Olsen | 108/51.3 |
| 4,145,974 | 3/1979 | Fleming et al. | 108/51.1 |

*Primary Examiner*—William E. Lyddane

*Attorney, Agent, or Firm*—Weinstein & Sutton

[57] ABSTRACT

There is provided an improved paperboard-load supporting pallet which includes a deck formed of a plurality of layers of paperboard material and also includes a plurality of runners attached to the bottom surface of the deck. Each of the runners includes spaced, parallel corrugations and is also formed of a plurality of layers of paperboard material. A novel method is also provided for forming the pallet of the present invention.

28 Claims, 8 Drawing Figures

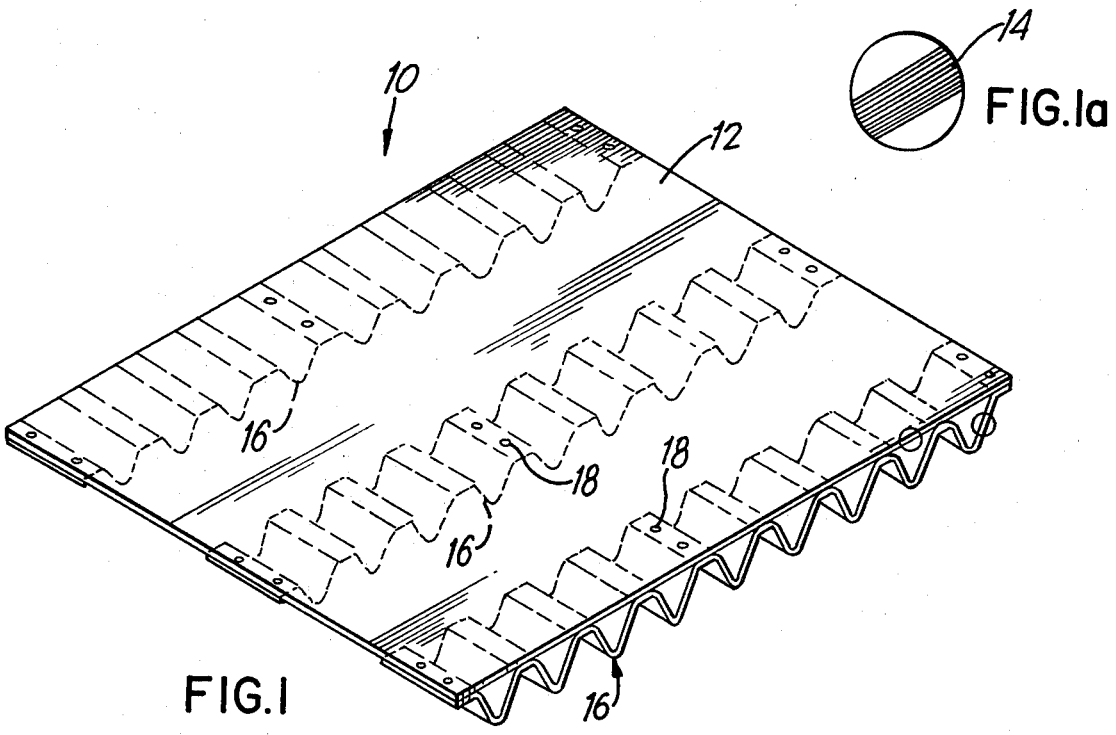
FIG.1a
FIG.1
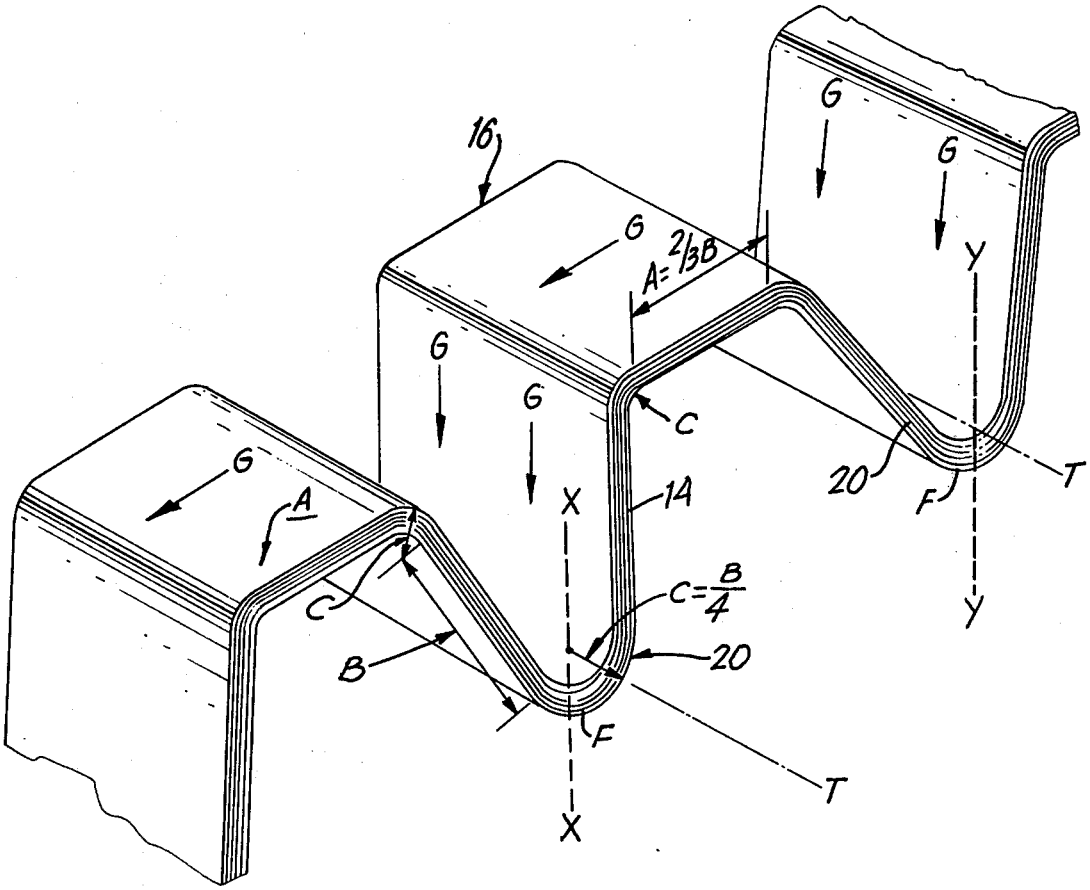
FIG. 2

PAPERBOARD LOAD-SUPPORTING PALLET

BACKGROUND OF THE INVENTION

The present invention generally relates to paperboard pallets for supporting loads and, more particularly, to the paperboard runners used in the making of such paperboard pallets. Advantageously, as a result of the present invention, an improved paperboard load-supporting pallet is provided which is inexpensive, disposable, recyclable, and has substantially increased structural rigidity and strength for heavy loads.

In the past, various types of constructions have been developed for making disposable pallets. Typically, such pallets have included paperboard material, such as in U.S. Pat. No. 3,911,834, and include a load-supporting deck and a plurality of legs disposed under the deck. Other examples of disposable pallets include U.S. Pat. No. 2,444,183; U.S. Pat. No. 2,503,240; U.S. Pat. No. 3,626,860; and U.S. Pat. No. 3,135,228. In addition, such prior art pallets employ various types of structural arrangements for the supporting legs or runners for the decks of the pallet. However, such disposable pallets have not found wide industry acceptance as substitutes for the more commonly-used wooden pallets, because of various drawbacks.

For example, it has been found that such prior art arrangements do not have the necessary structural rigidity, strength, and durability required by pallets to support heavy loads. Also, various problems have been experienced in the manufacture of such pallets, and the manufacturing costs have been higher than expected, so that such pallet constructions have not been inexpensive enough to make it economically feasible for such pallets to be disposable. Also, although paperboard material has been used in parts of the pallet construction, materials other than paperboard have also been employed in combination with the paperboard. As a result, the costs of material have been high, and the use of different types of materials has increased the manufacturing costs of the pallet.

Broadly, it is an object of the present invention to provide an improved paperboard load-supporting pallet which overcomes one or more of the aforesaid drawbacks. Specifically, it is within the contemplation of the present invention to provide an improved paperboard load-supporting pallet which is inexpensive, disposable, recyclable, durable, structurally rigid, and a method of making same.

It is a further object of the present invention to provide a load-supporting pallet having runners of improved construction which have a specific geometrical relationship and grain direction which improves their strength, rigidity and durability.

SUMMARY OF THE INVENTION

Briefly, in accordance with the principles of the present invention, there is provided an improved paperboard load-supporting pallet, which includes a deck formed of a plurality of layers of paperboard and also a plurality of runners attached to the bottom surface of the deck. Each of the runners includes a plurality of spaced, parallel corrguation sections and is also formed of a plurality of layers of paperboard. Each of the corrugation sections of a runner includes a flat section attached to the deck, two leg sections each connected to opposite ends of said flat section, and radius of curvature sections joining the flat sections and the leg sections, wherein the various dimensions of these sections have a specific geometrical relationship to improve the durability, strength, and rigidity of the construction of the load-supporting pallet.

More particularly, in the preferred embodiment, the length of a flat section A is equal to between one-third to two-thirds of the length of a leg section B, and each radius of curvature section C is equal to between one-eighth to one-fourth of the length of a leg section B. In addition, in the preferred embodiment, the paperboard layers of the deck and runners are adhered together by glue to improve their rigidity.

A still further significant feature of the runners of the present invention is that their grain direction extends perpendicular to the axis of the curved sections of the runners, which substantially improves the structural rigidity of the runner, on the order of 3 to 1, as compared to having the grain direction parallel to the axis of the curved sections of the runners.

In still another preferred embodiment, the upper surface of the deck is surrounded by a rail member or lip which serves the three functions of preventing articles from sliding off of the pallet, of preventing securing bands from digging into and/or damaging the articles being secured on the pallet, and provides additional structural rigidity to the pallet to prevent it from buckling.

Advantageously, as a result of the present invention, a load-supporting pallet is provided which is formed completely of paperboard material and is therefore inexpensive, disposable, recyclable, and the specific geometric relationship and grain direction with regard to the construction of the runners provides a construction which is structurally rigid, strong, and durable. In this manner, the paperboard load-supporting pallet of the present invention can be substituted for conventional wooden pallets which are expensive, non-disposable, and non-recyclable.

BRIEF DESCRIPTION OF THE DRAWINGS

Further objects, features, and advantages of the present invention will become apparent upon the consideration of the detailed description of the presently-preferred embodiment, when taken in conjunction with the accompanying drawings, wherein:

FIG. 1 is a perspective view of the improved paperboard load-supporting pallet;

FIG. 1*a* is a detailed magnified view of the layered construction of the deck and runners of the present invention;

FIG. 2 is a partial perspective view of a portion of one of the runners;

DETAILED DESCRIPTION OF THE PREFERRED EMBODIMENTS

Figure 3:
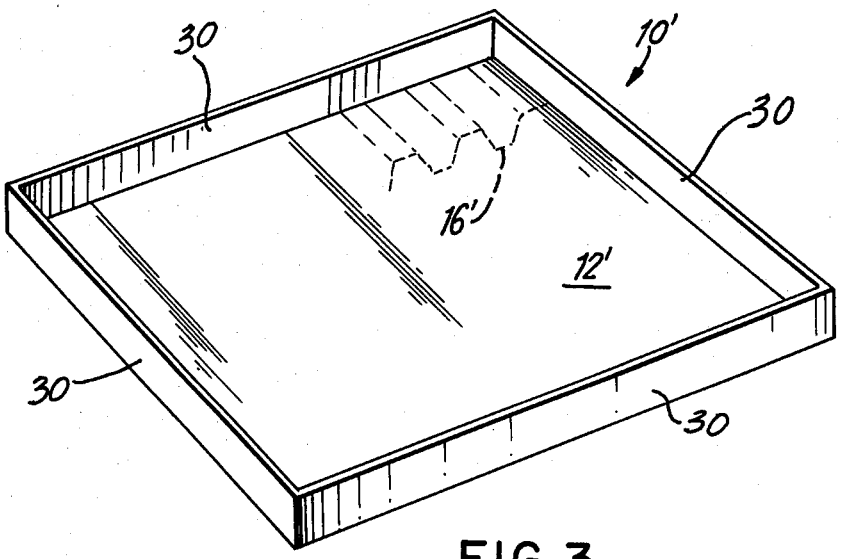
FIG. 3 is a perspective view of another embodiment of the present invention wherein a rail or lip member is provided on the deck of the pallet.

Referring now to FIG. 1, there is shown a paperboard load-supporting pallet embodying the principles of the present invention, generally designated by the reference numeral 10. The pallet includes a flat, rectangular-shaped deck 12 formed of a plurality of layers 14 of paperboard material, as shown in detail in FIG. 1*a*. In addition, the pallet includes a plurality of runners 16 attached to the bottom surface of deck 12. Each of the runners 16 is formed of a plurality of layers of paperboard material, which is also shown in detail in FIG. 1*a*.

Preferably, the deck 12 and runners 16 are each formed of 5 to 15 layers of paperboard material, wherein each of the layers is formed of between 10 point and 70 point paperboard. Preferably, the desired total of all of the layers to provide the necessary rigidity and durability for the deck and runners is 300 point paperboard. Of course, for heavier loads, it is well within the scope of the present invention to add additional layers of paperboard material to accommodate such heavier loads. It is found that a construction of 5 to 15 layers of paperboard totaling 300 point paperboard is of sufficient rigidity, strength, and durability to accommodate loads in the range of 2,000 pounds to 4,000 pounds for a pallet size of 48 inches by 48 inches or 40 inches by 48 inches. This is approximately 1,000 pounds per lineal foot. When heavier loads are expected, additional layers of paperboard material can be incorporated into the construction to accommodate such heavier loads.

It is also noted that each of the paperboard layers is adhered to each other by intervening layers of glue (not shown), which also enhances the strength and rigidity of the final construction of the deck 12 and runners 16. As is shown in FIG. 1, each of the runners 16 is attached to the deck by rivets 18, or other suitable means. For example, the runners 16 may also be attached to the bottom surface of the deck 12 by glue.

Referring to FIG. 2, a portion of a runner 16 is shown in detail. As shown therein, the runner 16 is formed of 10 to 15 layers of paperboard 14. In addition, the runner includes a plurality of spaced, parallel corrugation sections 20, wherein each of the corrugation sections extends between lines X—X and Y—Y. Each corrugation section icludes a flat section A, two identical leg sections B, each connected to opposite ends of the flat section A, and a radius of curvature section C at both the top and bottom of each leg section B. Each section C at the top of the leg section joins the leg sections B to the flat sections A, and the section C at the bottom of the leg sections joins the bottom of two leg sections B to form a curved floor contact area F. The curved area F avoids weakening or fracturing the board which occurs with sharp bends or right-angle bends.

It has been found that in order to substantially improve the structural rigidity, strength, and durability of the pallet of the present invention, the runners 16 should have a specific geometric relationship. More particularly, the length of a flat section A should be equal to between one-third and two-thirds of the length of a leg section B. For example, if the length of a flat section A is 4 inches, the length of a leg section B would preferably be 6 inches. With regard to the radius of curvature section C, it should be formed so that it is equal to between one-eighth and one-fourth of the length of a leg section B. Therefore, in this example, if leg section B has a length of 6 inches, the radius of the radius of curvature section C would be 1½ inches. In this example, the size of the deck 12 could be either 40 inches by 48 inches or 48 inches by 48 inches.

In addition, the runners 16 of the present invention have the paperboard fibers extending in the longitudinal direction of the runner at a ratio of approximately 3 to 1, so that the main grain direction G (see FIG. 2) of the fibers runs perpendicular to the transverse axes T of the curved sections C. As a result, the structural rigidity and strength of the runners are increased by approximately 3 to 1 as compared to having the grain direction parallel to transverse axes T. Basically, the present invention recognizes that by having the grain direction G perpendicular to the bends or curved sections, the structural rigidity (or resistance to deformation) is increased substantially, since there is more resistance to the board "giving" or weakening when the fibers or grain are in this direction.

As a result of such a grain direction and geometric relationship, the runners 16 of the pallet have improved strength and structural rigidity as compared to prior art arrangements. In addition, it is noted that since F is a curved area, the weight of the load on the pallet is distributed over a larger area than would be the case with a point contact, as in some prior art devices.

Referring to FIG. 3, there is shown an alternative embodiment of the present invention, wherein the pallet 10′ includes a flat deck 12′ and corrugated runners 16′ of a structure similar to that of FIG. 1. In addition, the pallet 10′ is provided with a rail or lip member 30 surrounding all four sides of the pallet 10′. The advantage of such a rail of lip member 30 is to provide the pallet with additional rigidity, so that the pallet 10′ has less of a tendency to buckle. In addition, such a rail member 30 prevents articles from sliding off of the pallet. Still further, when straps are applied to the pallet 10′ to secure articles to the pallet, the straps engage the lip or rail member 30, and thus protect the articles from having the straps dig into them or damage them. The rail member 30 can also be formed of a plurality of layers of paperboard material adhered together by glue.

Figure 4:
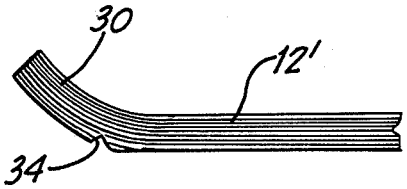
FIG. 4 is a sectional view showing how the rail of the present invention is constructed.
Figure 5:
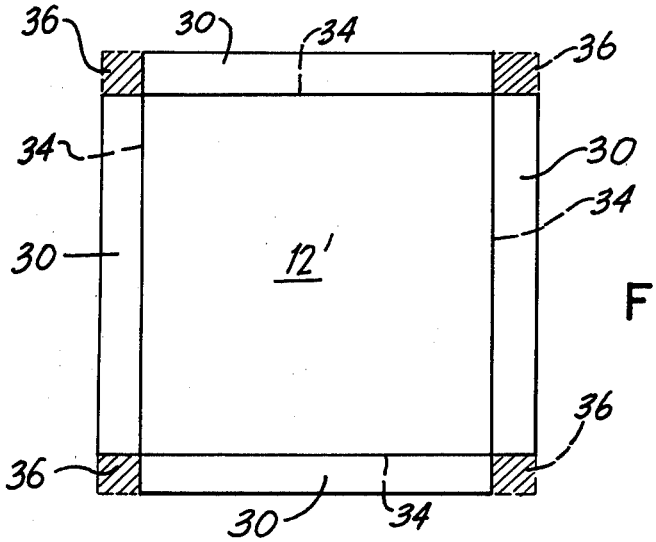
FIG. 5 illustrates a step in forming the rail member.

In FIGS. 4 and 5, there is shown a method for constructing a rail member 30. In this embodiment, deck 12′ is formed of a larger size along all four sides of the deck 12′. After the deck 12′ is formed, the bottom surface is scored at 34 along all four sides of the deck. The score line 34 is formed at a distance from the edge of the deck, which distance is equal to the desired height of the rail member 30. In this manner, the edges of the deck 12′ can be folded upwardly to form the rail members 30 of the deck 12′. Before folding, it is only necessary to remove corners 36.

Figure 6:
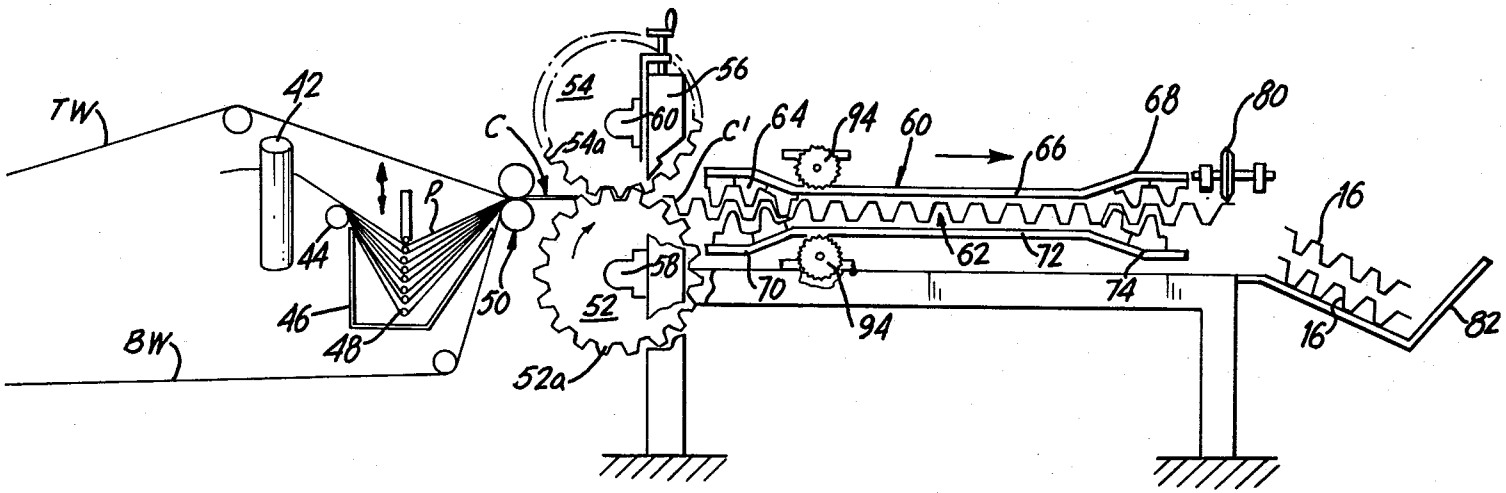
FIG. 6 is a side elevational view illustrating the steps in the method of forming the runners of the present invention.
Figure 7:
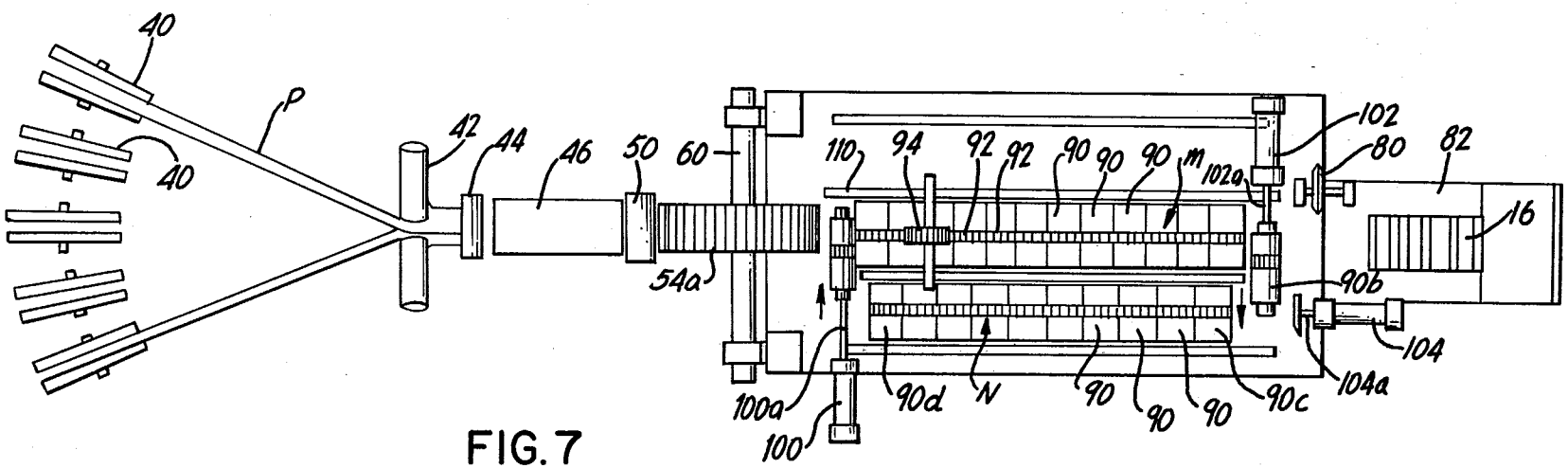
FIG. 7 is a top plan view of the arrangement shown in FIG. 6.

Referring to FIGS. 6 and 7, there is shown the method of manufacturing the runners 16 of the present invention for attachment to the bottom surface of the deck 12 or 12′. More particularly, layers of paperboard material P are supplied from a plurality of supply rolls 40 to guiding rolls 42 which causes the layers P to be brought into an overlapping relationship. As explained above, the grain direction G extends in the direction in which the board is moving. The plurality of layers P are directed over a roll 44 to a glue bath 46 containing a plurality of rollers 48 to maintain each of the layers in a spaced relationship while in the bath. The glue bath includes a silica and water mixture in the preferred embodiment, but other adhesives can be used. For example, any quick-drying glue may be employed. After passing through the glue bath 46, the plurality of layers P are directed to a pair of rollers 50 and are there joined by a top web TW and a bottom web BW to form a composite C, all webs with the same grain direction. Rollers 50 operate to hold all of the layers together and squeeze out any excess glue, with the rollers 50 operating to pull the layers P out of the glue bath. The composite C of all of the layers is then pulled into a forming station comprised of a pair of forming gears 52, 54 which are suitably mounted on a stand 56 by respective holders 58, 60. As will be noted, forming gear 52 is provided with teeth 52*a* which have a substantially flat configuration, whereas forming gear 54 includes teeth 54*a* having a somewhat more pointed configuration. In this manner, as the composite C passes through the forming gears of forming station, the desired shape and configuration of corrugations are imparted to the composite C, so that it exits from the forming station having the configuration shown at C'.

After the formed composite C' exits from the forming station, it is still wet and passes into a set of upper and lower die assemblies 60, 62. Upper die assembly 60 is formed in three sections, including a front section 64, a mid-section 66, and an end section 68. Similarly, lower die assembly 62 is formed in three sections 70, 72, and 74. As will be noted, in the initial entry sections 64, 70, the dies are spaced apart to allow for entry of the shaped composite C'. In the central section, upper and lower dies 66, 72 cooperate to place the still wet composite C' under pressure for about a minute to allow the glue to dry and to hold and retain the shape of the formed composite C'. At the end of the die assembly, the cooperating dies 68, 74 are again spaced apart to allow the shaped composite C' to exit from the die assemblies 60, 62. These die assemblies allow the paperboard to be formed and bent perpendicular to the grain direction, which is difficult or not possible with prior art arrangements.

As will be noted, adjacent the exit end of the die assembly 60, there is located a suitable cutting wheel 80 for cutting the composite C' transversely at spaced-apart distances to form the runners 16 into specific desired lengths. After being cut by cutting wheel 80, the runners 16 fall into a suitable bin 82 and are ready for attachment to the decks 12 to form the pallet of the present invention.

Referring to FIG. 7, the operation of the upper die assembly 60 is shown in greater detail and is identical to the operation of lower die assembly 62. As shown in FIG. 7, upper die assembly 60 includes a plurality of die blocks 90 which move along paths M and N. These die blocks 90 each include on their upper surface a track 92 adapted to be engaged and driven by a driving wheel 94 to provide continuously moving die blocks 90 for engagement with the composite C'. Accordingly, at any given time, a row of the die blocks 90 are in a forming location moving along path M, whereas another row of die blocks 90 are moving along path N.

As shown in FIG. 7, at the left end of the apparatus, a die block 90*a* is being pushed by a hydraulic cylinder 100 from the path N into the path M. As this is occurring, at the right-hand end of the apparatus, a hydraulic cylinder 102 is operating to push a die block 90*b* out of the path M and into the path N. After block 90*b* enters path N, a suitable hydraulic cylinder 104 operates to push die block 90*b*, and all of the other die blocks 90 in moving path N, toward the left of the apparatus. In this manner, the leading block 90*d* in path N is then moved into position in front of hydraulic cylinder 100 which, by then, has had its piston arm 100*a* retracted.

In this manner, the blocks 90 in moving path N are continuously moved to the left, so that the leading block 90*d* may be moved into the path M, to make room for a block 90 to be moved into the path N from the path M at the right-hand end of the assembly. With regard to path M, the blocks 90 are kept moving by driving wheel 94 which engages the tracks 92 on each of the die blocks 90 to move them from left to right along the moving path M. In addition, a suitable rack 110 is provided for engaging the edges of the die blocks 90 in moving path M to move them along from left to right. In this manner, as will be understood, a continuous arrangement is provided for continuously moving dies from the left end of forming path M to the right end of forming path M. A similar arrangement is provided for lower-die assembly 62 and need not be discussed in detail.

In view of the foregoing, an improved method has been provided for forming the continuous runners 16 of the present invention which operates in a continuous manner, and thereby reduces the cost of manufacturing the runners which are to be attached to the deck. Once the runners 16 are formed and moved into bin 82, it is only necessary to then attach the runners to the bottom surface of the deck 12 or 12' in order to form a completed pallet. Accordingly, as a result of the present invention, the runners and decks are formed in a very simple and inexpensive manner so that the final product is both inexpensive and disposable. In addition, since the final pallet product is formed totally of paperboard material, it is completely recyclable. Still further, as a result of the grain direction and dimensional relationships of the runners, they have sufficient strength, rigidity, and durability to be substituted for wooden pallets. Also, as a result of the curved contact area formed on the runners for contacting the floor, the load on the pallet is distributed over a larger area, so that the runners 16 are subjected to less stress and will thereby last longer. It is also noted that the pallet of the present invention is suitable for four-way pallet entry, since the forks can extend even through the corrugations.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A paperboard load-supporting pallet, comprising:

a flat deck formed of a plurality of layers of paperboard;

a plurality of runners extending in a longitudinal direction and attached to the bottom surface of said deck;

each of said runners being formed of a plurality of layers of paperboard and each of said runners including a plurality of spaced, parallel corrugation sections;

each of said corrugation sections including a flat section A attached to said deck, two leg sections B each connected to opposite ends of said flat section, and radius of curvature sections C each having a transverse axis; and said paperboard runners having a main grain direction in which a majority of the paperboard fibers extend in said longitudinal direction and perpendicular to said transverse axes to provide substantially improved structural rigidity to said runners.

2. A paperboard pallet according to claim 1, wherein at least two separate runners are attached to the bottom surface of said deck.

3. A paperboard pallet according to claim 1, wherein three separate runners are attached to the bottom surface of said deck.

4. A paperboard pallet according to claim 1, wherein the length of said flat section A is equal to between one-third and two-thirds of the length of a leg section B.

5. A paperboard pallet according to claim 1, wherein the radius of a radius of curvature section C is equal to between one-eighth and one-fourth of the length of a leg section B.

6. A paperboard pallet according to claim 1, wherein said runners are attached to said deck by glue.

7. A paperboard pallet according to claim 1, wherein said runners are attached to said deck by rivets.

8. A paperboard pallet according to claim 1, wherein said paperboard layers of said runners are adhered together by glue.

9. A paperboard pallet according to claim 1, wherein said paperboard layers of said deck are adhered together by glue.

10. A paperboard pallet according to claim 1, wherein the upper surface of said deck is surrounded by a rail member.

11. A paperboard pallet according to claim 1, wherein said leg sections B and said radius of curvature sections C cooperate to form a curved contact area over which the weight of a load on the pallet is distributed.

12. A paperboard pallet according to claim 1, wherein said paperboard fibers extend in said longitudinal direction of the runner at a ratio of substantially three to one.

13. A runner for a paperboard load-supporting pallet, wherein said pallet includes a deck formed of a plurality of paperboard layers, and wherein one or more of said runners are to be attached to spaced-apart locations on the bottom surface of said deck, comprising:

said runner being formed of a plurality of layers of paperboard and including a plurality of spaced, parallel corrugation sections;

each of said corrugation sections including a flat section A for attachment to the bottom surface of said deck, two leg sections B each connected to opposite ends of said flat section, and radius of curvature sections C each having a transverse axis; and said paperboard runner having a main grain direction in which a majority of the paperboard fibers extend perpendicular to said transverse axes to provide substantially improved structural rigidity to said runner.

14. A runner in accordance with claim 13, wherein the length of said flat section A is equal to between one-third and two-thirds of the length of a leg section B.

15. A runner in accordance with claim 13, wherein the radius of a radius of curvature section C is equal to between one-eighth and one-fourth of the length of said leg section B.

16. A runner in accordance with claim 13, wherein the paperboard layers of said runner are adhered together by glue.

17. A runner in accordance with claim 13, wherein said runner is formed of at least five layers of paperboard material adhered together by glue.

18. A runner in accordance with claim 13, wherein said paperboard fibers extend in the grain direction of the runner at a ratio of substantially three to one.

19. A method of making a paperboard load-supporting pallet, comprising the steps of:

forming a deck from a plurality of layers of paperboard;

forming runners from a plurality of layers of paperboard wherein each of said runners have a plurality of spaced, parallel corrugation sections; said corrugation sections having a flat section A for attachment to said deck, two leg sections B each connected to opposite ends of said flat section, and radius of curvature sections C each having a transverse axis;

forming said paperboard runners such that their main grain direction includes a majority of paperboard fibers which extends perpendicular to said transverse axes to provide substantially improved structural rigidity to said runners; and attaching a plurality of said runners to the bottom surface of said deck to form said pallet.

20. A method according to claim 19, wherein the step of forming said runners includes forming the length of said flat section A so that it is equal to between one-third and two-thirds of the length of said leg section B.

21. A method according to claim 19, wherein the step of forming said runners includes forming the radius of curvature sections C such that they are equal to between one-eighth and one-fourth of the length of said leg section B.

22. A method according to claim 19, wherein the step of attaching is performed by gluing said runners and deck to each other.

23. A method according to claim 19, wherein the step of attaching includes riveting said deck and runners to each other.

24. A method according to claim 19, wherein the step of forming said deck includes adhering said paperboard layers together by glue.

25. A method according to claim 19, wherein the step of forming said runners includes adhering said paperboard layers together by glue.

26. A method according to claim 19, further including the step of surrounding the upper surface of said deck with a rail member.

27. A method according to claim 19, further including scoring the bottom surface of said deck to form a rail member for surrounding said deck.

28. A method according to claim 19, wherein the step of forming said runners includes having the paperboard fibers extend in the main grain direction of the runner at a ratio of substantially three to one.

* * * * *